US007187902B2

(12) United States Patent
Asano

(10) Patent No.: US 7,187,902 B2
(45) Date of Patent: Mar. 6, 2007

(54) IMAGE FORMING APPARATUS

(75) Inventor: Fumio Asano, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 10/990,495

(22) Filed: Nov. 18, 2004

(65) Prior Publication Data

US 2005/0129439 A1 Jun. 16, 2005

(30) Foreign Application Priority Data

Dec. 10, 2003 (JP) ..... 2003-411820

(51) Int. Cl.
*G03G 15/00* (2006.01)

(52) U.S. Cl. ..... 399/401; 399/388

(58) Field of Classification Search ..... 399/107, 399/110, 124, 388, 401; 271/902
See application file for complete search history.

(56) References Cited

U.S. PATENT DOCUMENTS

| | | | | |
|---|---|---|---|---|
| 6,323,939 | B1 | 11/2001 | Suzuki | 355/407 |
| 6,330,425 | B1 * | 12/2001 | Ohuchi et al. | 399/401 |
| 6,484,003 | B2 * | 11/2002 | Tokutake et al. | 399/110 |
| 6,571,074 | B2 * | 5/2003 | Suzuki et al. | 399/124 |
| 6,574,451 | B2 * | 6/2003 | Miyasaka et al. | 399/401 |
| 6,621,997 | B2 | 9/2003 | Chung | 399/122 |
| 2002/0108359 | A1 | 6/2003 | Chung | 399/124 |
| 2004/0120744 | A1 * | 6/2004 | Fukada et al. | 399/401 |

FOREIGN PATENT DOCUMENTS

| | | |
|---|---|---|
| JP | 7-267461 | 10/1995 |
| KR | 10-388992 | 6/2003 |

OTHER PUBLICATIONS

Official Letter/Search Report issued by the European Patent Office in European Application No. 04027219.7 (Jul. 13, 2005).

* cited by examiner

*Primary Examiner*—Ren Yan
(74) *Attorney, Agent, or Firm*—Fitzpatrick, Cella, Harper & Scinto

(57) ABSTRACT

An image forming apparatus provided with an image forming portion for forming an image on a sheet, a sheet containing portion provided below the image forming portion and containing sheets to be supplied to the image forming portion, and a re-conveying path for again conveying the sheet having an image formed thereon to the image forming portion, wherein a portion of the lower side of the re-conveying path is disposed in the sheet containing portion.

10 Claims, 5 Drawing Sheets

IMAGE FORMING APPARATUS

BACKGROUND OF THE INVENTION

1. Field of the Invention

The invention relates to an image forming apparatus adapted to again convey a sheet having an image formed on the front surface (one surface) thereof to an image forming portion and form an image, and particularly to the construction of a re-conveying path for conveying a sheet again to the image forming portion.

2. Related Background Art

Heretofore, some of image forming apparatus such as printers having a digital optical system have been adapted to again convey a sheet having an image formed on the front side (one side) thereof to an image forming portion and form an image, and such an image forming apparatus is provided with a re-conveying path for again conveying the sheet having an image formed on the front side (one side) thereof to the image forming portion.

In such an image forming apparatus, as described, for example, in Japanese Patent Application Laid-open No. H07-267461, design is made such that a sheet contained in a sheet supplying cassette is fed to a sheet feeding apparatus, whereafter the fed sheet is conveyed to an image forming portion, a fixing portion and a discharging portion in succession by a sheet conveying apparatus, and when images are to be formed on the two sides of the sheet, the sheet is conveyed to a re-conveying path and is again conveyed to the image forming portion.

Now, as such a sheet conveying apparatus, use is widely been made of one provided with sheet conveying portions for conveying a sheet while nipping it between a pair of rotating cylindrical rollers, between a cylindrical roller and a runner, and between a cylindrical roller and a pad or the like, and these sheet conveying portions are disposed in a sheet conveying path such as a re-conveying path to thereby convey the sheet. The rotating speeds and ON-OFF timing of these sheet conveying portions are changed, whereby it becomes possible to control the movement of the sheet easily.

Now, adjacent ones of the sheet conveying portions, even in the most spaced apart state, are disposed with an interval which enables a sheet shortest in the length in a conveying direction (hereinafter referred to as the shortest sheet) to be nipped. Also, the sheet conveying path is curved for the downsizing of the apparatus and the construction of each processing, and in a case where the sheet conveying portions are provided in such a curved sheet conveying path, the sheet, from after it is conveyed from the upstream sheet conveying portion until it is nipped by the downstream sheet conveying portion, is conveyed along a sheet conveying guide portion or the like provided between the two sheet conveying portions.

FIG. 5 of the accompanying drawings schematically shows the construction of a conventional image forming apparatus provided with such a sheet conveying apparatus, and a sheet P discharged from a sheet supplying cassette 50 containing sheets P therein by a feeding apparatus 51 is first conveyed to an image forming portion 60 by sheet conveying portions 52 and 53 disposed downstream of the feeding apparatus 51 and at positions whereat they can nip the shortest sheet at a time, and a toner image formed in this image forming portion 60 is transferred to the sheet P.

Next, the sheet P to which the toner image has been transferred is conveyed to a fixing apparatus 61, where the toner image is fixed, whereafter the sheet P is discharged to a discharged sheet stacking portion 72 by discharging rollers 70 via a discharged sheet conveying route 71.

Now, this image forming apparatus is designed to be capable of effecting two-side printing which forms images on the two-sides of the sheet P, and multiplex printing which forms images on the sheet P in superimposed relationship with one another, and design is made such that when the two-side printing is to be effected, or when the multiplex printing is to be effected, the sheet having had an image formed on one side thereof after it has been passed through the fixing apparatus 61 is partly discharged to the discharged sheet stacking portion 72, whereafter the sheet is directed to a reversal conveying path 80 which is a re-conveying path by the reverse rotation of the discharging rollers 70 and a changeover mechanism (not shown), and is again conveyed to the image forming portion 60 via the reversal conveying path 80.

Then, the sheet P thus conveyed to the image forming portion 60 receives the transfer of a toner image in the image forming portion 60 as in the case of one-side printing, whereafter the toner image thereon is fixed in the fixing apparatus 61, whereafter the sheet P is discharged to the discharged sheet stacking portion 72 via the discharged sheet conveying route 71.

In such a conventional image forming apparatus, however, if as shown in FIG. 5, the reversal conveying path 80 is provided in a vertical direction, it is necessary that for example, a U-shaped reversing portion 81 for changing the conveying direction of the downwardly conveyed sheet P and directing it to the image forming portion 60 be provided downstream of the reversal conveying path 80. When the U-shaped reversing portion 81 is thus provided downstream of the reversal conveying path 80, the height of the apparatus body of the apparatus becomes greater by an amount corresponding to the vertical length of the reversing portion 81, and the size of the entire apparatus also becomes larger.

SUMMARY OF THE INVENTION

The present invention has been made in view of such a situation, and has as an object thereof to provide an image forming apparatus provided with a re-conveying path which can made the height of the apparatus body of the apparatus smaller.

The present invention also has as an object thereof to provide an image forming apparatus provided with:

an image forming portion provided in an apparatus body of said image forming apparatus for forming an image on a sheet;

a sheet containing portion provided below the image forming portion, for containing therein sheets to be supplied to the image forming portion; and a re-conveying path for conveying the sheet having an image formed thereon to the image forming portion, wherein a portion of the lower side of the re-conveying path is disposed in the sheet containing portion.

Also, the present invention has as an object thereof to provide an image forming apparatus provided with:

an image forming portion provided in an apparatus body of the apparatus;

a sheet supplying cassette disposed below the image forming portion;

a discharged sheet stacking portion disposed above the image forming portion;

a conveying path disposed in a vertical direction connecting the sheet supplying cassette, the image forming portion and the discharged sheet stacking portion together; and a re-conveying path disposed in a vertical direction connecting the discharged sheet stacking portion and the upstream side of the image forming portion together, wherein a U-turn path constituting the lower side of the re-conveying path is formed in the sheet supplying cassette.

DETAILED DESCRIPTION OF THE PREFERRED EMBODIMENTS

Some embodiments for carrying out the present invention will hereinafter be described in detail with reference to the drawings. The dimensions, material, shapes, relative arrangements, etc. of constituent parts described in these embodiments are not intended to restrict the scope of this invention thereto unless specifically described.

Figure 1:
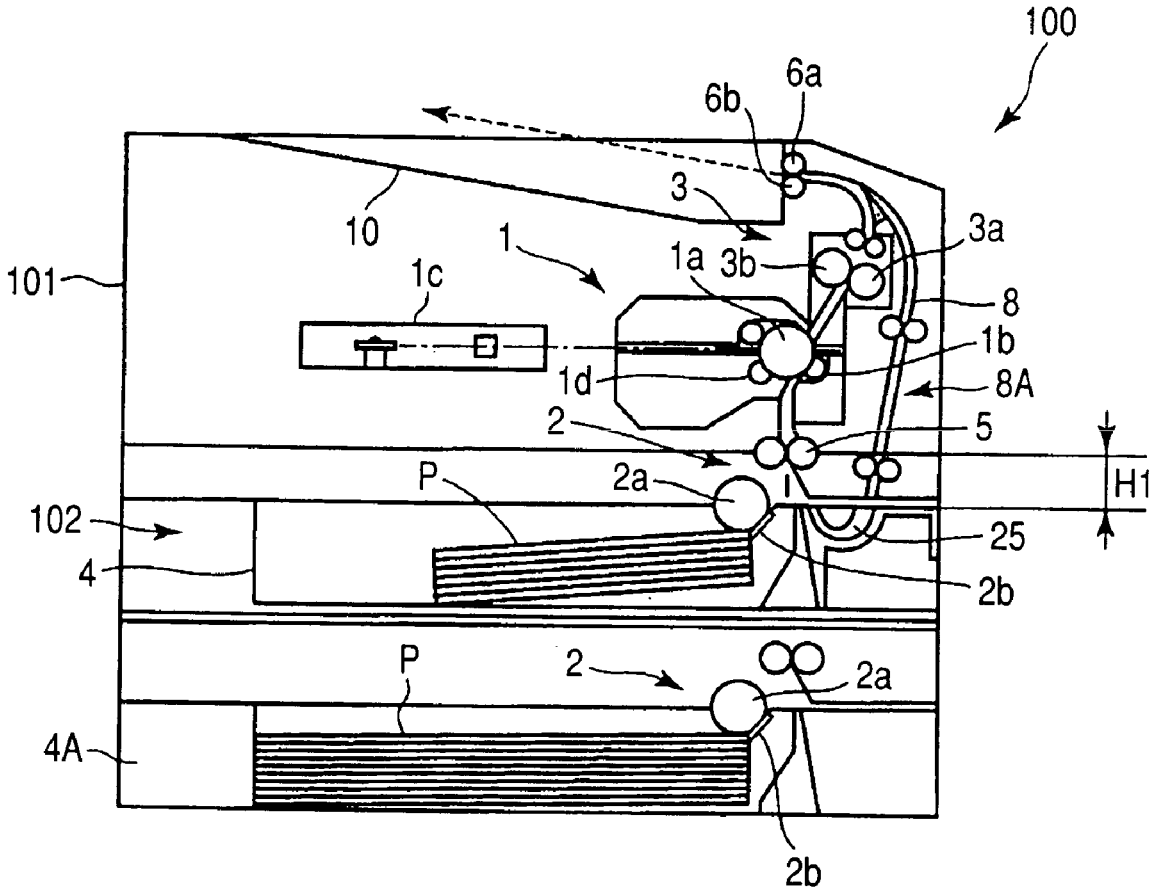
FIG. 1 schematically shows the construction of a laser beam printer which is an example of an image forming apparatus according to a first embodiment of the present invention.

FIG. 1 schematically shows the construction of a laser beam printer which is an example of an image forming apparatus according to a first embodiment of the present invention.

Referring to FIG. 1, the laser beam printer 100 comprises a laser beam printer body (hereinafter referred to as the printer body) 101 which is the apparatus body of the image forming apparatus of the present invention. This printer body 101 which is the apparatus body is provided with an image forming portion 1 provided with a photosensitive drum 1*a*, a transfer roller 1*b*, etc., a sheet feeding portion 2 disposed below the image forming portion 1 for feeding a sheet P to the image forming portion 1, and a fixing portion 3 disposed above the image forming portion 1 for fixing an image on the sheet. This fixing portion 3 is provided with a pressure roller 3*a* and a heating roller 3*b*, and effects heating and pressurization on the sheet to which a toner image has been transferred.

Also, this laser beam printer 100 is designed to be capable of forming an image on the back side of the sheet having an image formed on one side thereof, and is provided with a re-conveying path 8A for reversing and again conveying the sheet P after the image has been formed on one side thereof to the image forming portion 1.

Further, a sheet supplying cassette 4 which is a sheet containing portion is detachably provided in the lower portion of the printer body 101 (below the image forming portion 1). A sheet supplying cassette containing space 102 is provided in the lower portion of the printer body 101. Also, an option feeder 4A is mounted under the printer body 101.

In the laser beam printer 100 of such a construction, when an image is to be formed on the sheet P, exposure is first effected on the surface of the photosensitive drum is conformity with an image signal by a scanner unit 1*c* to thereby form an electrostatic latent image on the peripheral surface of the photosensitive drum 1*a*, whereafter the electrostatic latent image formed on the photosensitive drum is developed by a developing device 1*d* to thereby form a toner image on the photosensitive drum.

In parallel with this toner image forming operation, the sheets P contained in the sheet supplying cassette 4 or the option feeder 4A are separated one by one by a feeding roller 2*a* and a separating pad 2*b*, and only the uppermost sheet is fed to a pair of registration rollers 5. Thereafter, the sheet P has its leading edge rammed against the pair of registration rollers 5 being at a halt and forms a loop, whereby the skew feed thereof is corrected.

After the skew feed of the sheet P has been thus corrected, the pair of registration rollers 5 starts to be rotated so that the leading edge of the toner image on the peripheral surface of the photosensitive drum and the print starting position of the sheet P may coincide with each other, that is, in synchronism with an image writing start position, whereby the sheet P is conveyed to a transferring portion constituted by the photosensitive drum 1*a* and the transfer roller 1*b*, and the toner image is transferred to the sheet P.

Next, the sheet P to which the toner image has been transferred is conveyed to the fixing portion 3, and is heated and pressurized by the pressure roller 3*a* and heating roller 3*b* of this fixing portion 3, whereby the toner image is heat-fixed, whereafter the sheet P is discharged to a discharged sheet stacking portion 10 with its image formed side facing down by a pair of discharging rollers 6*a* and 6*b*.

On the other hand, in case of two-side printing, when the sheet P after the toner image has been fixed on the front side (one side) thereof is being discharged to the discharged sheet stacking portion 10, a controlling portion (not shown) reverses the rotation of the pair of discharging rollers 6*a* and 6*b*. When the pair of discharging rollers 6*a* and 6*b* are thus reversely rotated, the sheet P comes into the re-conveying path 8A with its front side and back side reversed, whereafter it is again conveyed to the image forming portion 1. The sheet P having been thus re-conveyed to the image forming portion 1, after a toner image has been transferred onto the back side as onto the front side, has the toner image thereon fixed by the fixing portion, whereafter it is discharged to the discharged sheet stacking portion 10 by the pair of discharging rollers 6*a* and 6*b*.

Figure 2:
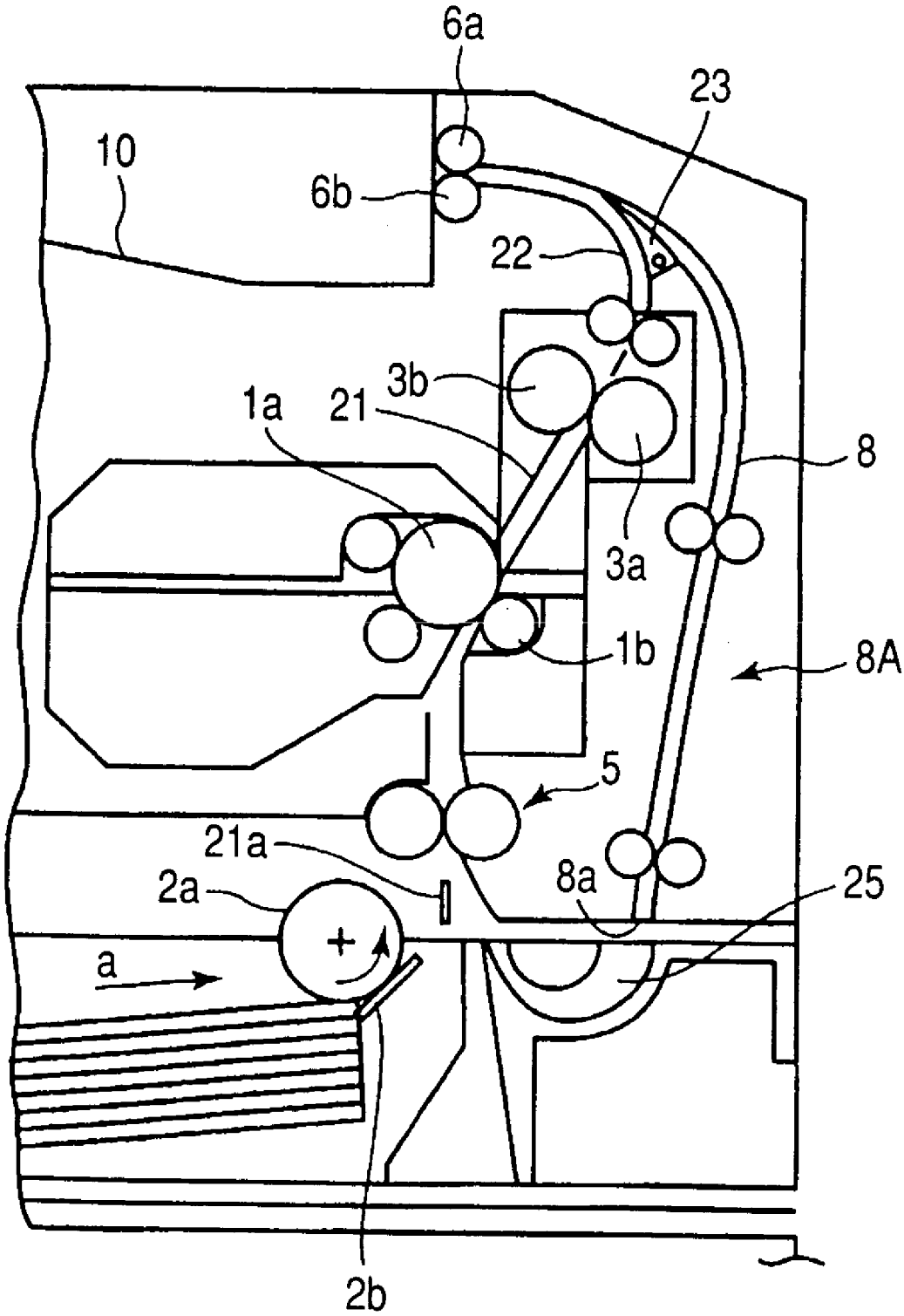
FIG. 2 is an enlarged view of the essential portions of the printer body of the laser beam printer.

FIG. 2 is an enlarged view of the essential portions of the printer body 101 of such a construction. In FIG. 2, a first guide member 21*a* guides to the pair of registration rollers 5 the uppermost one of the sheets separated one by one by the feeding roller 2*a* and the separating pad 2*b*. A first conveying path 21 conveys the sheet P to which the toner image has been transferred to the fixing portion 3. A second conveying path 22 conveys the sheet P on which the toner image has been fixed to the pair of discharging rollers 6*a* and 6*b*.

This second conveying path 22 joins a re-conveying path 8 which is the printer body side portion of the re-conveying path 8A in the downstream side portion thereof, and a flapper 23 is provided in the joining portion of the second conveying path 22 and the re-conveying path 8. This flapper 23 is adapted to be in a position shown in FIG. 2 when the sheet P having an image formed thereon is to be discharged to the discharged sheet stacking portion 10, and to be moved in a counter-clockwise direction by the controlling portion (not shown) after the trailing edge of the sheet P has passed the flapper 23 when images are to be formed on the two sides of the sheet P. Thereby, when the pair of discharging rollers 6*a* and 6*b* are reversely rotated thereafter, the sheet P is adapted to pass on the upper surface of the flapper 23 and come into the re-conveying path 8.

After it has thus come into the re-conveying path 8, the sheet P is directed to the interior of the printer body and is conveyed to the pair of registration rollers 5, whereafter it assumes a conveyance form similar to that in the case of one-side printing, and finally is discharged to the discharged sheet stacking portion 10, thus terminating a series of image forming processes.

Now, when images are to be formed on the two sides of the sheet, the exit 8*a* of the re-conveying path 8 into which the sheet P comes lies above the sheet supplying cassette containing space 102 (see FIG. 1) as shown in FIG. 2. The sheet discharged from this exit 8*a* of the re-conveying path 8 has its conveyance direction changed by a U-turn path 25 which is a reversing path provided below it, and is again directed to the interior of the printer body so as to be conveyed to the pair of registration rollers 5.

That is, in the present embodiment, the re-conveying path 8A for again conveying the sheet P having an image formed thereof to the image forming portion 1 is constituted by the re-conveying path 8 and the U-turn path 25.

Figure 3:
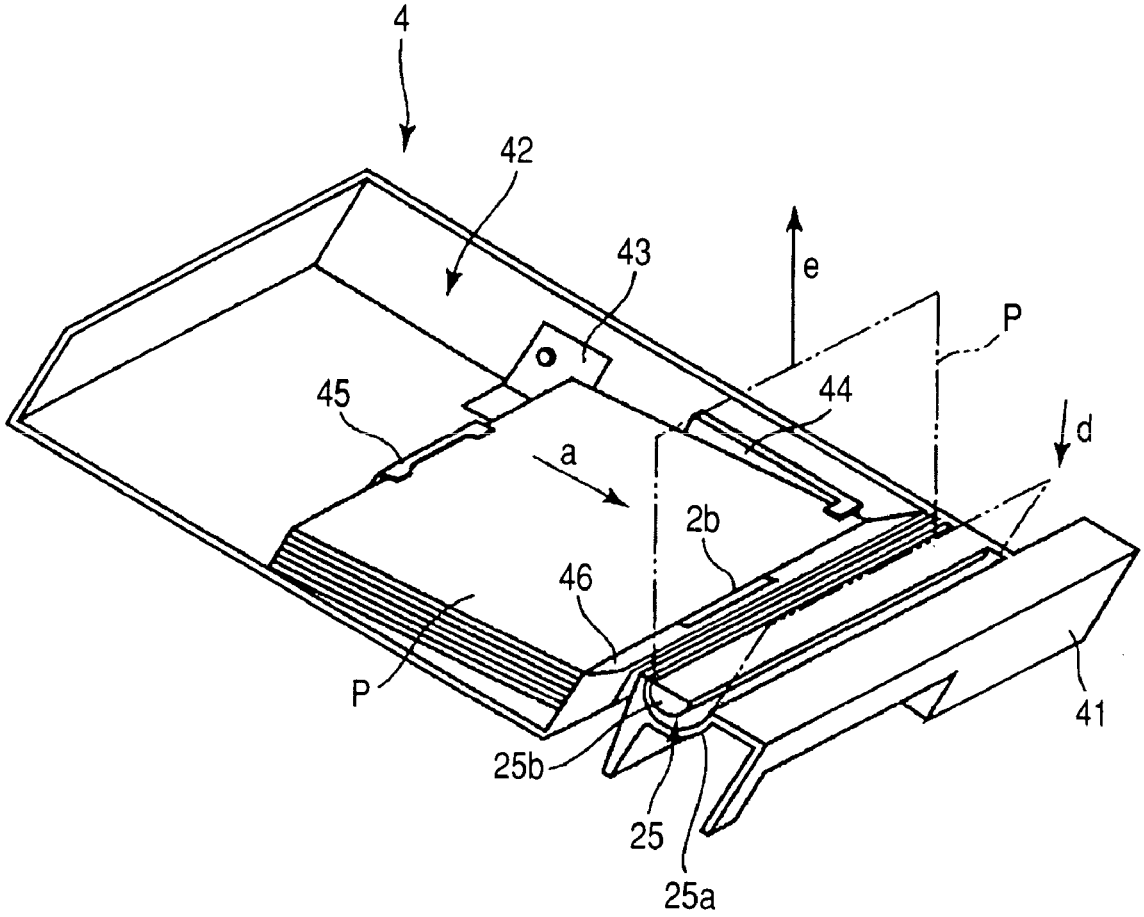
FIG. 3 is a perspective view illustrating the construction of a sheet supplying cassette mounted on the printer body.

In the present embodiment, the U-turn path 25 is provided between the drawing-out handle 41 and a sheet containing area 42 of the sheet supplying cassette 4, as shown in FIG. 3. In FIG. 3, a sheet placing plate 43 is provided in the containing area 42 for pivotal movement in a vertical direction, and the sheets P are placed thereon, and the sheets P are biased toward the feeding roller 2*a* by a spring (not shown) or the like. A side gulating plate 44 regulates the positions of the opposite side edges of the sheets P placed on the sheet placing plate 43 in the widthwise direction thereof orthogonal to a sheet conveying direction indicated by the arrow "a". A trailing edge regulating plate 45 regulates the position of the trailing edge of the sheets P.

Also, a lower guide 46 is provided on the fore end of the sheet supplying cassette 4 which is the side edge portion thereof in the sheet conveying direction. The separating pad 2*b* is disposed at a location on this lower guide 46 which is opposed to the feeding roller 2*a*.

On the other hand, the U-turn path 25 of the sheet supplying cassette 4 is formed by a lower guide portion 25*a* formed between the drawing-out handle 41 and the sheet containing area 42 and extending in the widthwise direction and downwardly smoothly curved, and an upper guide portion 25*b* disposed on the lower guide portion 25*a* with an interstice through which the sheet P can pass provided therebetween.

By such a U-turn path 25 being formed in the sheet supplying cassette 4, the sheet P discharge from the exit 8*a* of the re-conveying path 8 as already described comes into the U-turn path 25 from a direction indicated by the arrow "d", and thereafter passes through the U-turn path 25 and is conveyed in a direction indicated by the arrow "e", and is again directed into the interior of the printer body and is conveyed to the pair of registration rollers 5.

Figure 5:
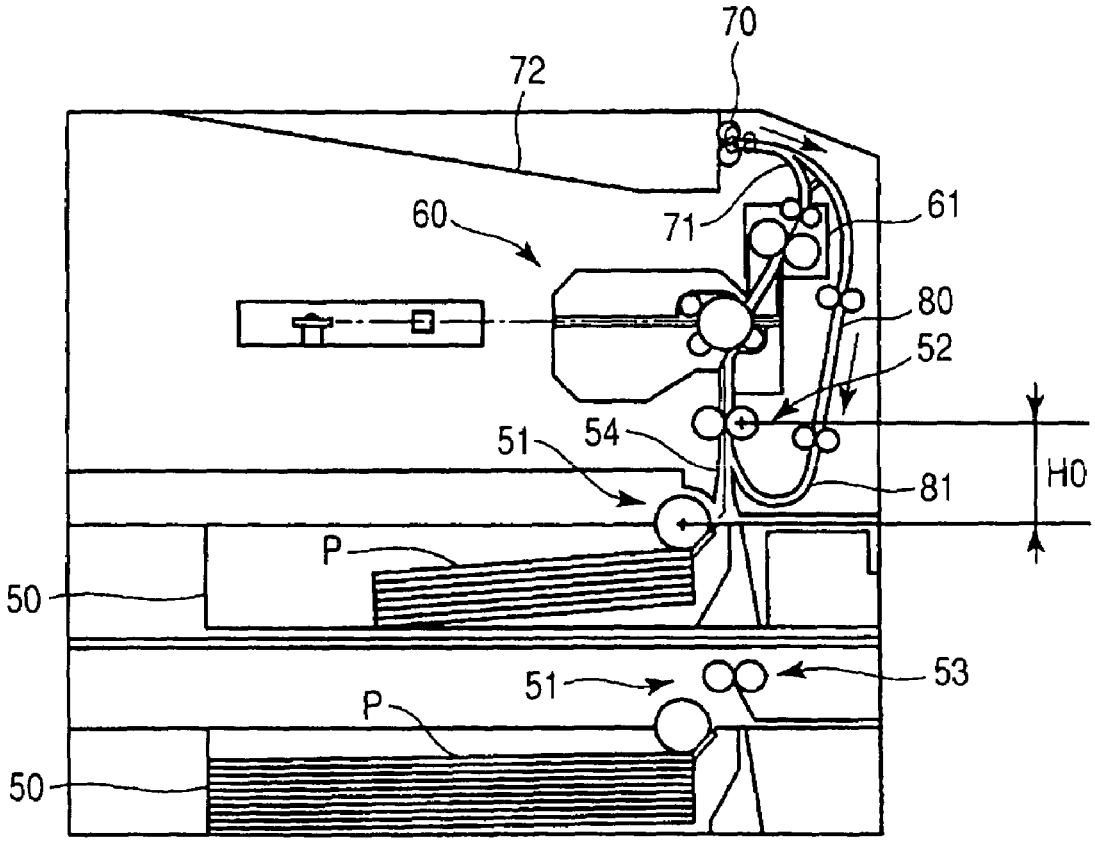
FIG. 5 schematically shows the construction of a conventional image forming apparatus.

Now, by the U-turn path 25 being thus provided on the drawing-out side end portion of the sheet supplying cassette 4, that is, by a portion (downstream side portion) of the re-conveying path 8A being formed in the sheet supplying cassette 4, as shown in FIG. 1, the distance H1 between the feeding roller 2*a* and the pair of registration rollers 5 in the re-conveying path 8 which is the re-conveying path portion of the printer body side becomes shorter as compared with the vertical distance H0, for example, between the feeding roller 2*a* and the pair of registration rollers 5 in the re-conveying path 80 of the already described conventional image forming apparatus shown in FIG. 5.

By the distance H1 between the feeding roller 2*a* and the pair of registration rollers 5 in the re-conveying path 8 thus becoming shorter, that is, by the vertical length of the re-conveying path 8 becoming shorter, the height of the printer body 101 can be made small, whereby the size of the entire printer can also be made small. Also, by the U-turn path 25 of the re-conveying path 8A being formed in the sheet supplying cassette 4, the re-conveying path 8A can be opened when the sheet supplying cassette 4 is drawn out of the printer body 101, whereby the removal of a jammed sheet, the cleaning of the apparatus, etc. can be done easily.

A second embodiment of the present invention will now be described.

Figure 4:
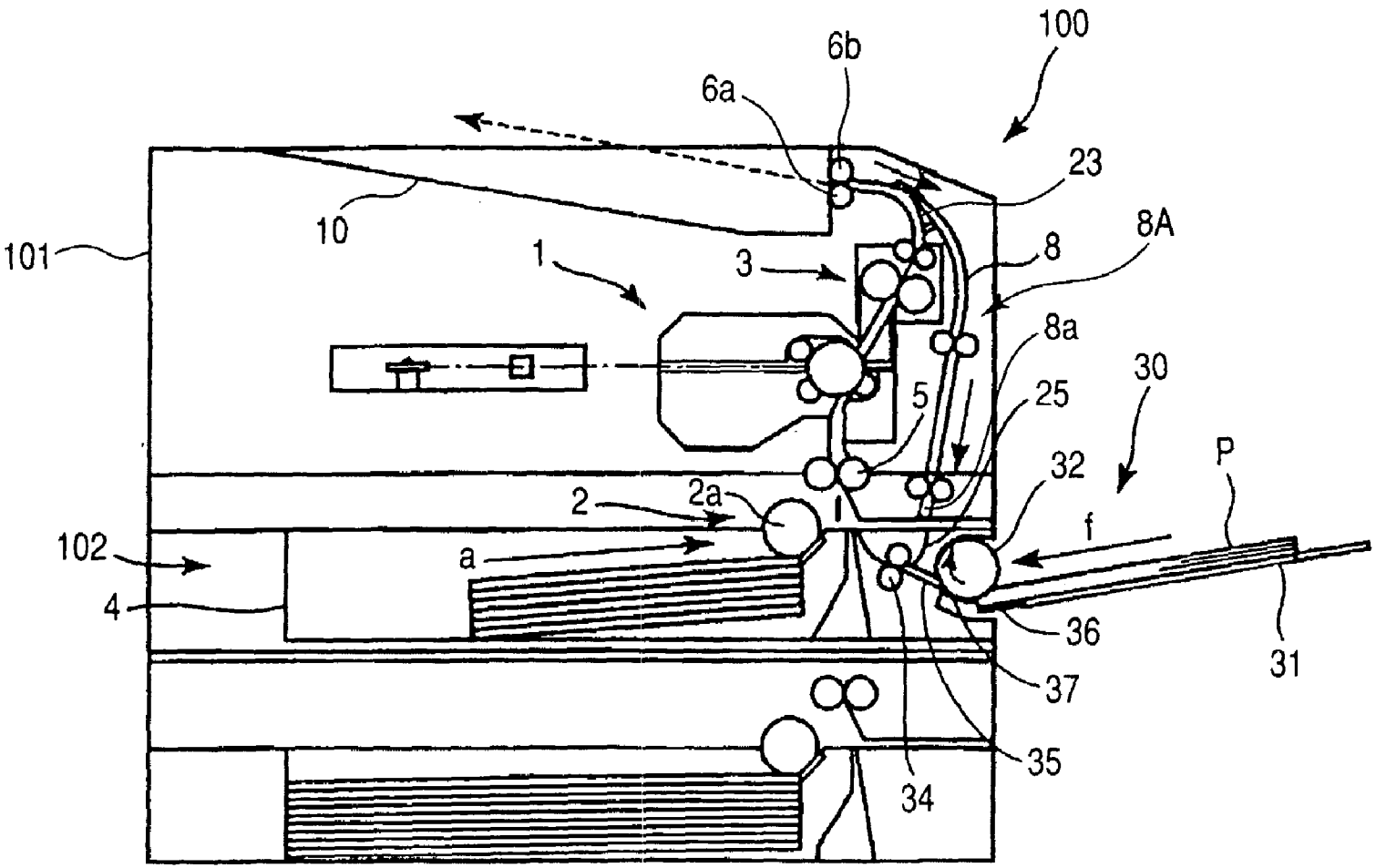
FIG. 4 schematically shows the construction of a laser beam printer which is an example of an image forming apparatus according to a second embodiment of the present invention.

FIG. 4 schematically shows the construction of a laser beam printer which is an example of an image forming apparatus according to the present embodiment. In FIG. 4, the same reference characters as those in FIG. 1 designate the same or corresponding portions.

In FIG. 4, a multi-feeding apparatus 30 provided in the sheet supplying cassette 4 in which the sheets P is set by a user is a sheet feeding portion for feeding the sheets P one by one to the image forming portion 1. This multi-feeding apparatus 30 is provided with a sheet stacking portion 31 for stacking the sheets P thereon, and a conveying roller 32. A conveying path 35 directs the sheet P conveyed by the conveying roller 32 to the U-turn path 25.

When the sheets P are to be fed from this multi-feeding apparatus 30, the conveying roller 32 is first rotated in a clockwise direction as viewed in FIG. 4, whereby the sheets P nipped between the conveying roller 32 and a separating sheet 36 are conveyed in a direction indicated by the arrow "f", and are separated one by one by a separating pad 37. The thus separated sheet P is conveyed along a conveying path 35 into the printer body via the U-turn path 25 by conveying rollers 34.

Thereafter, this sheet P, in the case of one-side printing, is conveyed to the image forming portion 1 as already described, and a toner image is transferred thereto, whereafter the sheet P is conveyed to the fixing portion 3 and the toner image is fixed thereon, whereafter the sheet P is discharged to the discharged sheet stacking portion 10.

Also, in the case of two-side printing, the sheet P is directed to the reversal conveying path 8 by the reverse rotation of the pair of discharging rollers 6*a* and 6*b* and the changeover of the flapper 23, whereafter it is again conveyed to the image forming portion 1 via the reversal conveying path 8. The sheet P thus conveyed to the image forming portion 1 receives the transfer of a toner image in the image forming portion 1 as in the case of the one-side printing, whereafter the toner image thereon is fixed in the fixing portion 3, and thereafter the sheet P is discharged to the discharged sheet stacking portion 10.

Again in the present embodiment, as in the already described first embodiment, in case of two-side printing, the sheet P conveyed to the reversal conveying path 8 is passed through the U-turn path 25 provided in on the drawing-out side edge portion of the cassette 4 discretely from the sheet containing area 42 in opposed relationship with the exit 8*a*, after passed through the exit 8*a* of the reversal conveying path 8, and is again conveyed to the interior of the printer body.

By adopting such a construction, the height of the printer body 101 can be made small as in the case of the first embodiment even if the multi-feeding apparatus 30 is provided. While in the present embodiment, the multi-feeding apparatus 30 as a sheet feeding portion is provided in the sheet supplying cassette 4, a manually feeding apparatus for feeding a sheet and having not the sheet stacking portion 31 may be provided instead of the multi-feeding apparatus 30.

This application Claims priority from Japanese Patent Application No. 2003-411820 filed on Dec. 10, 2003, which is hereby incorporated by reference herein.

What is claimed is:

1. An image forming apparatus comprising:

an image forming portion provided in an apparatus body of said image forming apparatus for forming an image on a sheet;

a sheet containing portion provided below said image forming portion for containing sheets to be supplied to said image forming portion, said sheet containing portion being detachably provided in the apparatus body; and a re-conveying path for conveying the sheet having an image formed thereon to said image forming portion, wherein a portion of a lower side of said re-conveying path is disposed in a drawing-out side end portion of said sheet containing portion, the portion of the lower side of said re-conveying path disposed in said sheet containing portion is formed in a U-shape, and an entrance and an exit of the portion formed in the U-shape are opened to an upper surface of said sheet containing portion.

2. An image forming apparatus according to claim 1, wherein said image forming portion forms an image on a sheet conveyed from a lower side to an upper side of the apparatus body, said re-conveying path is disposed in a vertical direction to again convey to said image forming portion the sheet on which the image has been formed in said image forming portion, and a reversing path constituting the lower side of said re-conveying path is formed in said sheet containing portion.

3. An image forming apparatus according to claim 2, wherein said reversing path is a path having a substantially U-shaped cross section and opening to an upper surface of said sheet containing portion, and upwardly reverses the sheet downwardly conveyed along said re-conveying path and feeds it toward said image forming portion.

4. An image forming apparatus according to claim 1, wherein registration means is disposed below said image forming portion, sheet discharging means is disposed above said image forming portion, said re-conveying path is disposed in a vertical direction to re-convey the sheet from said sheet discharging means to said registration means, and a reversing path constituting the lower side of said re-conveying path is formed in said sheet containing portion.

5. An image forming apparatus according to claim 4, wherein said reversing path is a path having a substantially U-shaped cross section and opening to an upper surface of said sheet containing portion, and upwardly reverses the sheet downwardly conveyed along said re-conveying path and feeds it toward said registration means.

6. An image forming apparatus according to claim 2 or 4, wherein a sheet feeding portion for supplying a sheet other than the sheets contained in said sheet containing portion is provided in said sheet containing portion, and the sheet is fed out from said sheet feeding portion to said reversing path.

7. An image forming apparatus according to claim 2 or 4, wherein said sheet containing portion is detachably provided in an apparatus body, and said reversing path is disposed adjacent and a sheet containing area containing the sheets.

8. An image forming apparatus comprising:

an image forming portion provided in an apparatus body of said image forming apparatus;

a sheet supplying cassette disposed below said image forming portion, said sheet supplying cassette being detachably provided in the apparatus body;

a discharged sheet stacking portion disposed above said image forming portion;

a conveying path disposed in a vertical direction connecting said sheet supplying cassette, said image forming portion and said discharged sheet stacking portion together; and a re-conveying path disposed in a vertical direction connecting said discharged sheet stacking portion and an upstream side of said image forming portion together, wherein a U-turn path constituting a lower side of said re-conveying path is formed in a drawing-out side end portion of said sheet supplying cassette, and an entrance and an exit of said U-turn path are opened to an upper surface of said sheet supplying cassette.

9. An image forming apparatus according to claim 8, wherein said sheet supplying cassette is provided in said apparatus body so as to be capable of being drawn out, and said U-turn path is disposed adjacent a sheet containing area containing sheets.

10. An image forming apparatus according to claim 8, wherein a multi-feeding apparatus for supplying a sheet other than sheets contained in said sheet supplying cassette is provided in said sheet supplying cassette, and a conveying path connecting said multi-feeding apparatus and said U-turn path together is provided.

* * * * *

UNITED STATES PATENT AND TRADEMARK OFFICE

CERTIFICATE OF CORRECTION

PATENT NO. : 7,187,902 B2
APPLICATION NO. : 10/990495
DATED : March 6, 2007
INVENTOR(S) : Fumio Asano It is certified that error appears in the above-identified patent and that said Letters Patent is hereby corrected as shown below:

COLUMN 2:
Line 43, “made” should read --make--.

COLUMN 3:
Line 66, “is” should read --in--.

COLUMN 5:
Line 12, “comes” should read --passes,--.
Line 30, “gulating” should read --regulating--.

COLUMN 7:
Line 3, “having not” should read --not having--.

COLUMN 8:
Line 16, “and” should be deleted.

Signed and Sealed this

Eighteenth Day of September, 2007

JON W. DUDAS
*Director of the United States Patent and Trademark Office*